US007217075B2

(12) United States Patent
Kenji et al.

(10) Patent No.: US 7,217,075 B2
(45) Date of Patent: May 15, 2007

(54) TAPE FEEDER AND METHOD OF CONTROLLING THE SAME

(75) Inventors: Umehara Kenji, Tokyo (JP); Jae-Geol Choi, Seoul (KR); Jeong-Ho Kim, Seoul (KR)

(73) Assignees: KRDC Co., Ltd., Seoul (KR); Gradco Ltd., Tokyo (JP)

( * ) Notice: Subject to any disclaimer, the term of this patent is extended or adjusted under 35 U.S.C. 154(b) by 208 days.

(21) Appl. No.: 10/892,551

(22) Filed: Jul. 16, 2004

(65) Prior Publication Data

US 2006/0012100 A1 Jan. 19, 2006

(51) Int. Cl.
*B42B 5/00* (2006.01)

(52) U.S. Cl. ..... 412/6; 412/33; 412/37

(58) Field of Classification Search ..... 412/6, 412/33, 34, 36, 37

See application file for complete search history.

(56) References Cited

U.S. PATENT DOCUMENTS 3,939,513 A * 2/1976 Crathern et al. ..... 412/1
4,917,366 A * 4/1990 Murakami et al. ..... 270/58.09
5,174,556 A * 12/1992 Taylor et al. ..... 270/1.02
5,193,962 A * 3/1993 Parker et al. ..... 412/8
5,213,317 A * 5/1993 Mandel et al. ..... 270/58.11
5,237,898 A * 8/1993 Kubisiak ..... 83/227
5,697,747 A * 12/1997 Sawada et al. ..... 412/16
5,735,659 A * 4/1998 Kosasa et al. ..... 412/9
5,833,423 A * 11/1998 Yamaguchi et al. ..... 412/8
6,572,318 B2 * 6/2003 Cobene et al. ..... 412/11
6,652,210 B1 * 11/2003 Yeaple ..... 412/37
6,899,505 B2 * 5/2005 Hataya ..... 412/36

* cited by examiner

*Primary Examiner*—Douglas Hess
(74) *Attorney, Agent, or Firm*—Greenblum & Bernstein, P.L.C.

(57) ABSTRACT

A tape feeder and a method of controlling the same are disclosed, in which an automatic feeding tape and a manual feeding tape are selectively fed to a binding device. In the method of controlling a tape feeder comprising a tape feeding portion structured to selectively feed manual feeding tapes and automatic feeding tapes to a tape heating unit, a stack cassette having the automatic feeding tapes therein, and a tape moving path moving the automatic feeding tapes in the stack cassette to the tape feeding portion, wherein the tape moving path includes a slot into which the manual feeding tapes are externally input, an automatic feeding tape sensor, and a tape feeding sensor, and the tape feeding portion includes a tape aligning position sensor sensing the position where the automatic feeding tape or the manual feeding tape has been fed to the tape heating unit, the method is characterized in that the manual feeding tape prior to the automatic feeding tape is moved to the tape feeding portion by a signal of the tape feeding sensor when the automatic feeding tape sensor and the tape feeding sensor respectively sense the automatic feeding tape and the manual feeding tape.

8 Claims, 11 Drawing Sheets

PRIOR ART

PRIOR ART

PRIOR ART

TAPE FEEDER AND METHOD OF CONTROLLING THE SAME

BACKGROUND OF THE INVENTION

1. Field of the Invention

The present invention relates to a binding device that binds papers ejected from a digital output device such as a printer and a copier by finishing them, and more particularly to a tape feeder and a method of controlling the same in which a binding tape can automatically and manually be fed to the binding device.

2. Discussion of the Related Art

An example of a conventional binding device is disclosed in Japanese Patent Publication No. 8-301504. The conventional binding device will be described with reference to FIG. 1 to FIG. 4.

The conventional binding device 1 includes a paper processing unit 5, a paper carriage 2, a tape feeder 6, a tape heating unit 7, and a receiving stacker 8. The paper processing unit 5 is provided with a paper aligning unit 3 and a binding unit 4. The paper carriage 2 includes an inlet 9*a* and an outlet 9*b*. A plurality of rollers 10 are provided between the inlet 9*a* and the outlet 9*b*. A flapper 13 is provided at the inlet 9*a* so that papers are flapped to a paper carriage path 14 when binding papers. The papers flapped to the paper carriage path 14 by the flapper 13 are conveyed to the paper aligning unit 3. The paper aligning unit 3 includes a tray 16 receiving papers, an aligning paddle 18 aligning conveyed papers, a stop finger 19 putting the papers in a standby state, and a paper clamp 15 gripping the papers aligned in the stop finger 19 and moving them to the tape heating unit 7.

The stop finger 19 and the paper clamp 16 are designed to grip the papers stacked on the tray 16 to move them to the tape heating unit 7. Once the papers are moved to the tape heating unit 7, the papers are subject to the binding process so that a tape fed from the tape feeder 6 is adhered to the sections and sides of the papers. The paper clamp 15 moves the bound papers to the binding carriage 4 and returns to the position where it first grips the papers. The bound papers are then stacked on the receiving stacker 8 by the binding carriage 4.

In the aforementioned binding device, the tape feeder 6 and the tape heating unit 7 will be described in more detail.

The tape heating unit 7 includes a tape guide 26, a center heater 27, and a driving gear 30 driving the center heater 27. The tape guide 26 is fed with the tape 32 from the tape feeder 6 before the papers aligned by the paper aligning unit 3 are moved to the tape heating unit 7.

The tape feeder 6 includes a tape reel R1, a tape cutter 33, and a tape moving means 34. The tape wound in the tape reel R1 is cut by the tape cutter 33 at a predetermined length and is moved to a carriage C by the tape moving means 34. The tape 32 is fed to the tape guide 26 by the tape moving means 34.

Afterwards, the center heater 27 is moved from the standby position (not shown) to the heating position by the driving gear 30, and the tape 32 starts to be preheated.

Once the section of the papers aligned by the paper aligning unit 3 is carried to a contact position H of the center heater 27, as shown in FIG. 4, the section and the side of the papers 35 are bound by the tape 32.

Once the binding process is finished by adhering the section of the papers to the tape, the bound papers are passed from the contact position H of the center heater to the binding carriage 4 by the paper aligning unit 3 and then moved to the receiving stacker 8. The tape guide 26 and the center heater 27 return to the original standby position by means of their respective driving gears 30 and 31. Since the tape feeder 6 of the aforementioned conventional binding device is structured to have the tape 32 wound in the reel R1, the reel requires a large space (volume) and the complicated step such as fixing the tape to the reel R1 is required. Also, there is convenience that the tape is reset by stopping the operation of the binding device to change the color of the tape. For example, supposing that ten volumes of papers are bound with ten colored tapes, the tape should be reset ten times to change the color. This could lead to deteriorate efficiency of the process. Further, when some characters are required to be printed on the tape as the case may be, the complicated printing process is required. If the characters should be printed on the tape while changing the color of the tape for each unit of binding papers, it is difficult to bind the papers with the conventional reel type tape. When the binding process is performed by setting the tape to be automatically fed to the binding device, there is a structural problem that it is difficult to bind the papers for each unit by adding another tape.

To solve such problems, in the present invention, automatic feeding tapes cut in advance are stacked on a stack cassette and are fed to the tape feeder one by one through a tape moving path. The tape moving path is provided with a manual feeding tape slot. The moving priority of the automatic feeding tape and the manual feeding tape is determined by a signal of a tape feeding sensor provided in the tape feeder.

To set the cut automatic feeding tapes to be stacked on the stack cassette, the method of feeding the automatic feeding tape one by one without any error should be preceded. As shown in FIG. 3, since a solid type additive 32*a* changed to liquid state when it is heated at a predetermined temperature of 100° C. to 200° C. is adhered to the tape 32 used for the binding device, the additive 32*a* causes friction among the stacked automatic feeding tapes. In this case, the automatic feeding tape is not likely to be slid and taken out from the stack cassette, thereby resulting in feeding error of the tape.

In the present invention, to avoid such error, once a dividing motor of the automatic feeding tape is operated, a first pinion roller and a second pinion roller are simultaneously rotated so that the pinion of the roller pushes the automatic feeding tape to move it to a frictional pad. The frictional pad includes a frictional surface that passes only one automatic feeding tape pushed by the pinion roller and a spring that pressurizes the frictional surface toward the automatic feeding tape.

The tape that had passed through the frictional pad is moved to the tape heating unit through the tape feeder, and the manual feeding tape is selectively fed to the tape heating unit.

SUMMARY OF THE INVENTION

The present invention is directed to a tape feeder and a method of controlling the same that substantially obviates one or more of the problems due to limitations and disadvantages of the related art.

An object of the present invention is to provide a tape feeder having a small volume by removing a reel type tape structure.

Another object of the present invention is to provide a tape feeder that feeds an automatic feeding tape and a manual tape to a tape heating unit by setting them to be easily exchanged with each other.

Other object of the present invention is to provide a method of controlling a tape feeder that can timely feed a tape to adapt to a binding period.

Additional features and advantages of the invention will be set forth in the description which follows, and in part will be apparent from the description, or may be learned by practice of the invention. The objectives and other advantages of the invention will be realized and attained by the scheme particularly pointed out in the written description and claims hereof as well as the appended drawings.

To achieve these and other advantages and in accordance with the purpose of the present invention, as embodied and broadly described, in a binding device including a paper aligning unit aligning papers to be bound, a tape heating unit binding the papers aligned in the paper aligning unit, a tape feeder feeding tapes to the tape heating unit, and a binding carriage carrying the bound papers to stack them on a receiving stacker, the tape feeder includes a tape feeding portion structured to selectively feed manual feeding tapes and automatic feeding tapes to the tape heating unit, a stack cassette having the automatic feeding tapes therein, and a tape moving path moving the automatic feeding tapes in the stack cassette to the tape feeding portion, wherein the tape moving path is provided with a slot into which the manual feeding tapes are externally input.

The tape moving path includes an automatic feeding tape sensor and a tape feeding sensor, and the tape feeding portion includes a tape aligning position sensor sensing the position where the automatic feeding tape or the manual feeding tape has been fed to the tape heating unit.

In another aspect of the present invention, in a method of controlling a tape feeder comprising a tape feeding portion 80 structured to selectively feed manual feeding tapes and automatic feeding tapes to a tape heating unit, a stack cassette having the automatic feeding tapes therein, and a tape moving path moving the automatic feeding tapes in the stack cassette to the tape feeding portion, wherein the tape moving path includes a slot into which the manual feeding tapes are externally input, an automatic feeding tape sensor, and a tape feeding sensor, and the tape feeding portion includes a tape aligning position sensor sensing the position where the automatic feeding tape or the manual feeding tape has been fed to the tape heating unit, the method is characterized in that the manual feeding tape prior to the automatic feeding tape is moved to the tape feeding portion by a signal of the tape feeding sensor when the automatic feeding tape sensor and the tape feeding sensor respectively sense the automatic feeding tape and the manual feeding tape.

The tape moving path includes a tape thickness sensor that senses whether the manual feeding tape and the automatic feeding tape are overlapped with each other on the tape moving path, and movement of the tape is stopped if the tape thickness sensor senses the tapes overlapped with each other.

The stack cassette includes pinion rollers driven by a automatic feeding tape dividing motor and a carriage roller driven by the automatic feeding tape carriage motor, and the tape feeding portion includes a tape feeding roller driven by a tape feeding motor, the tape feeding roller moving the automatic feeding tape or the manual feeding tape to the tape moving path by the signal of the tape feeding sensor.

It is to be understood that both the foregoing general description and the following detailed description are exemplary and explanatory and are intended to provide further explanation of the invention as claimed.

BRIEF DESCRIPTION OF THE ATTACHED DRAWINGS

The invention will be described in detail with reference to the following drawings in which like reference numerals refer to like elements wherein.

Figure 5A:
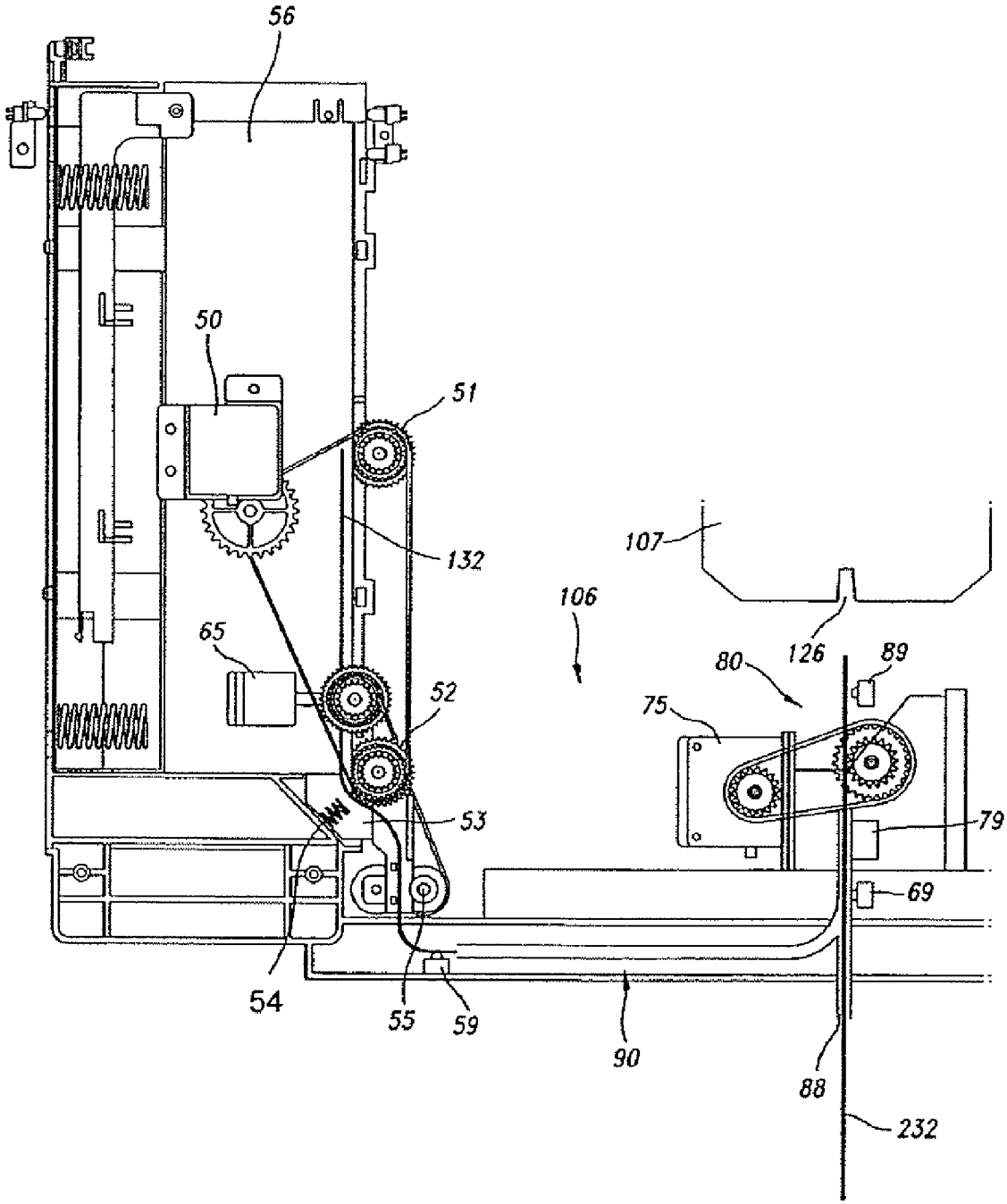
Figure 5B:
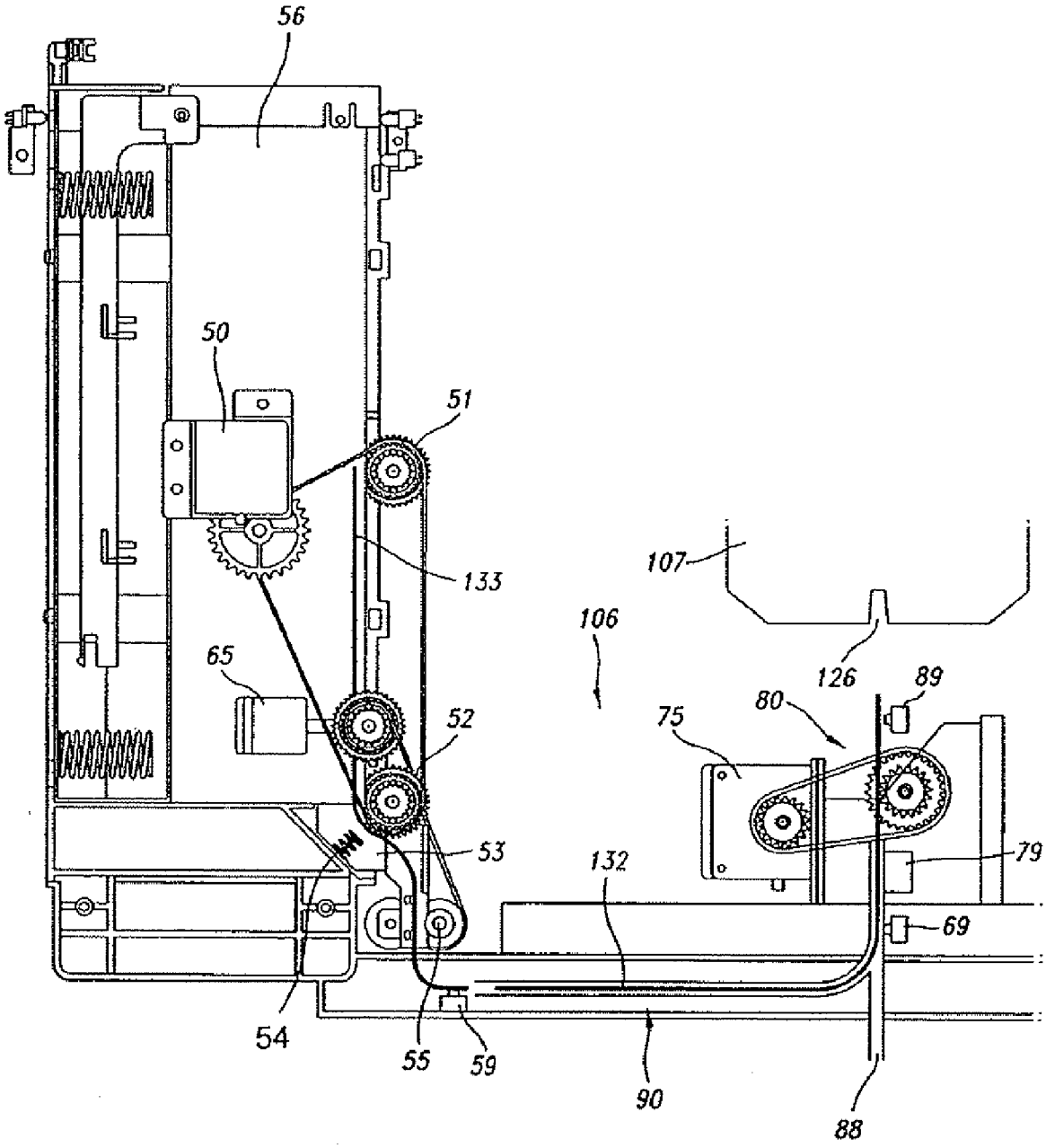
Figure 6:
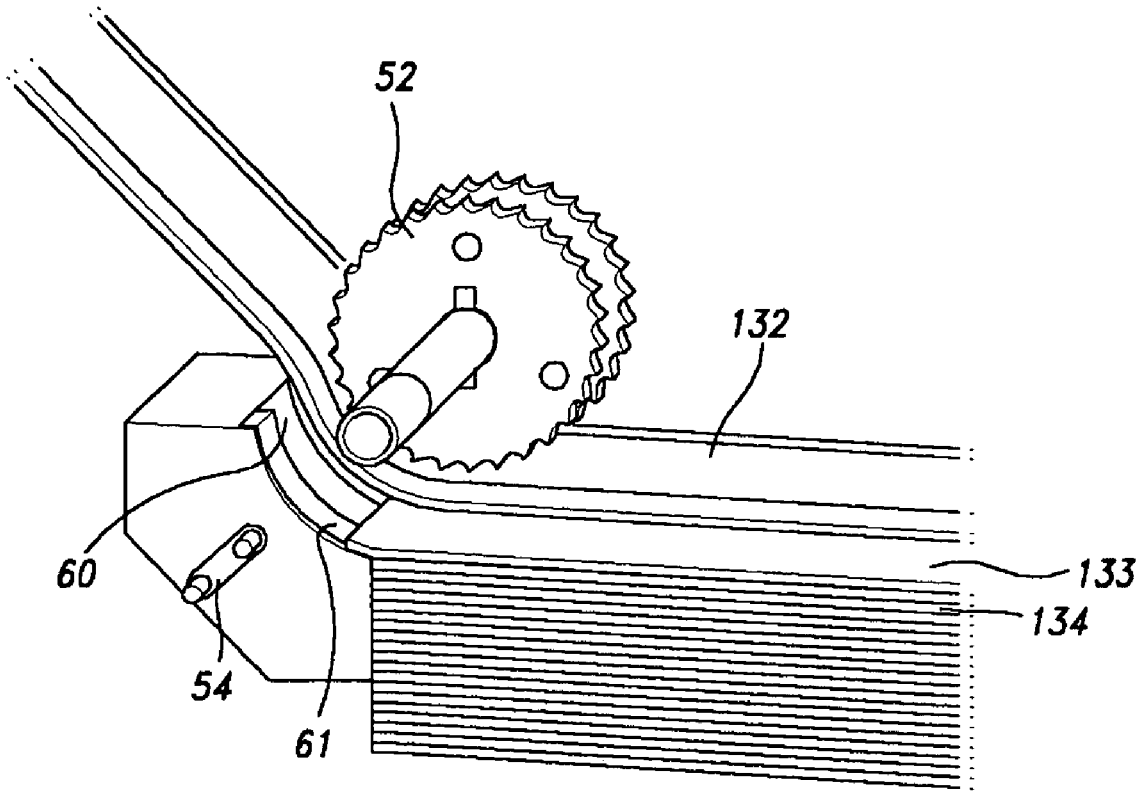
Figure 7:
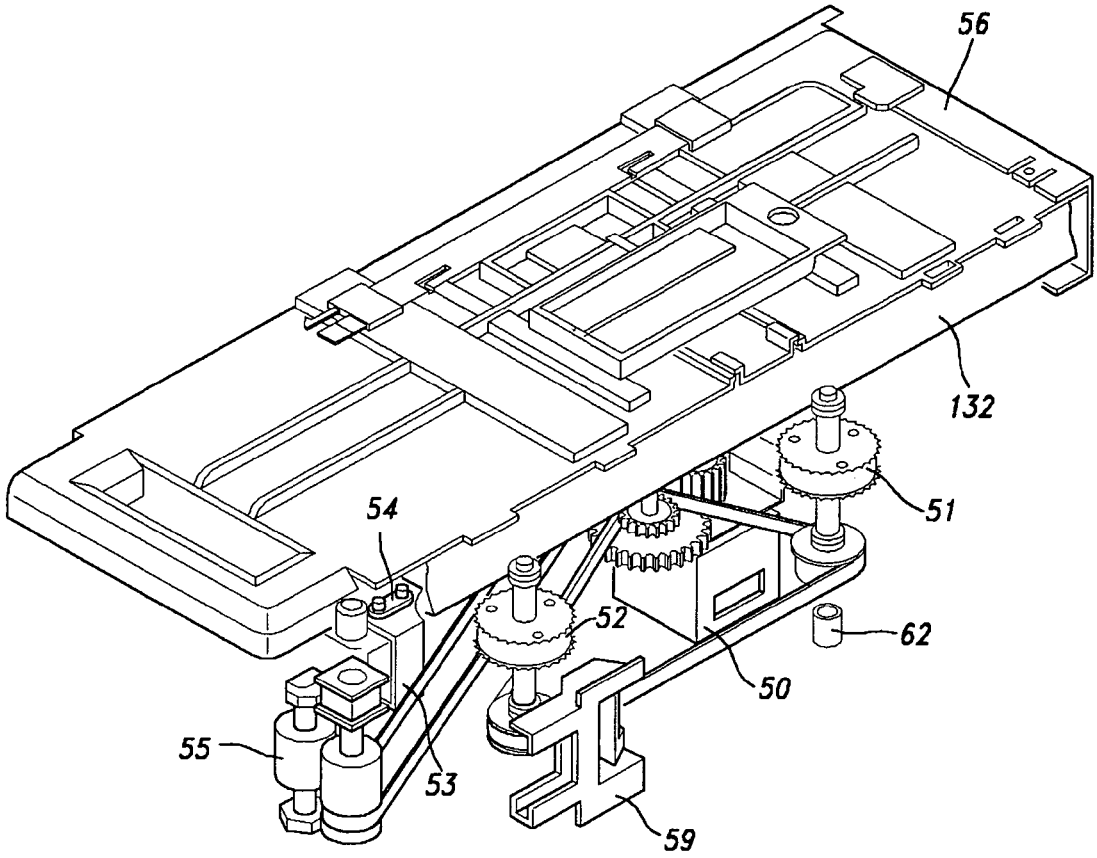
Figure 8:
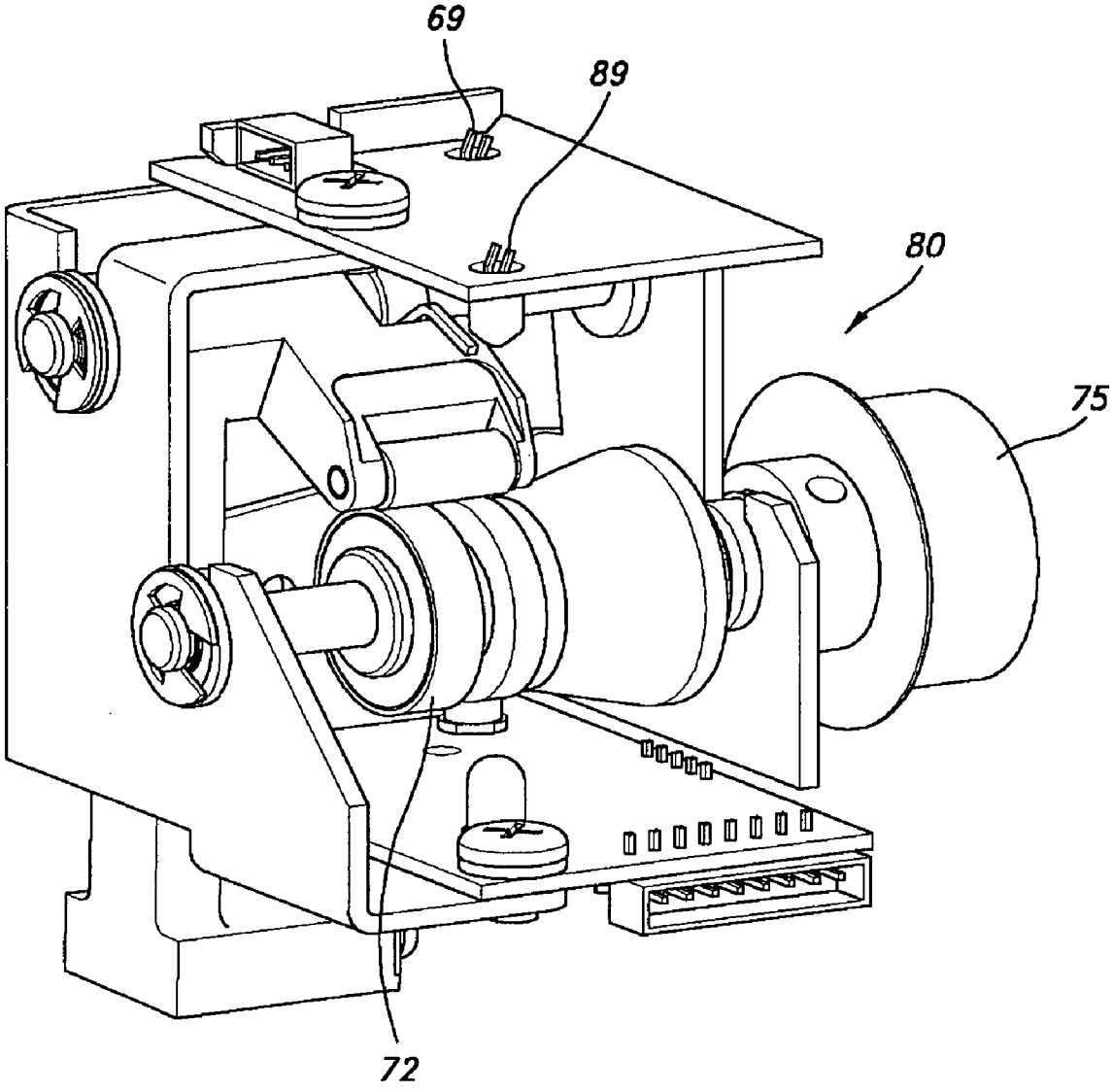
Figure 9:
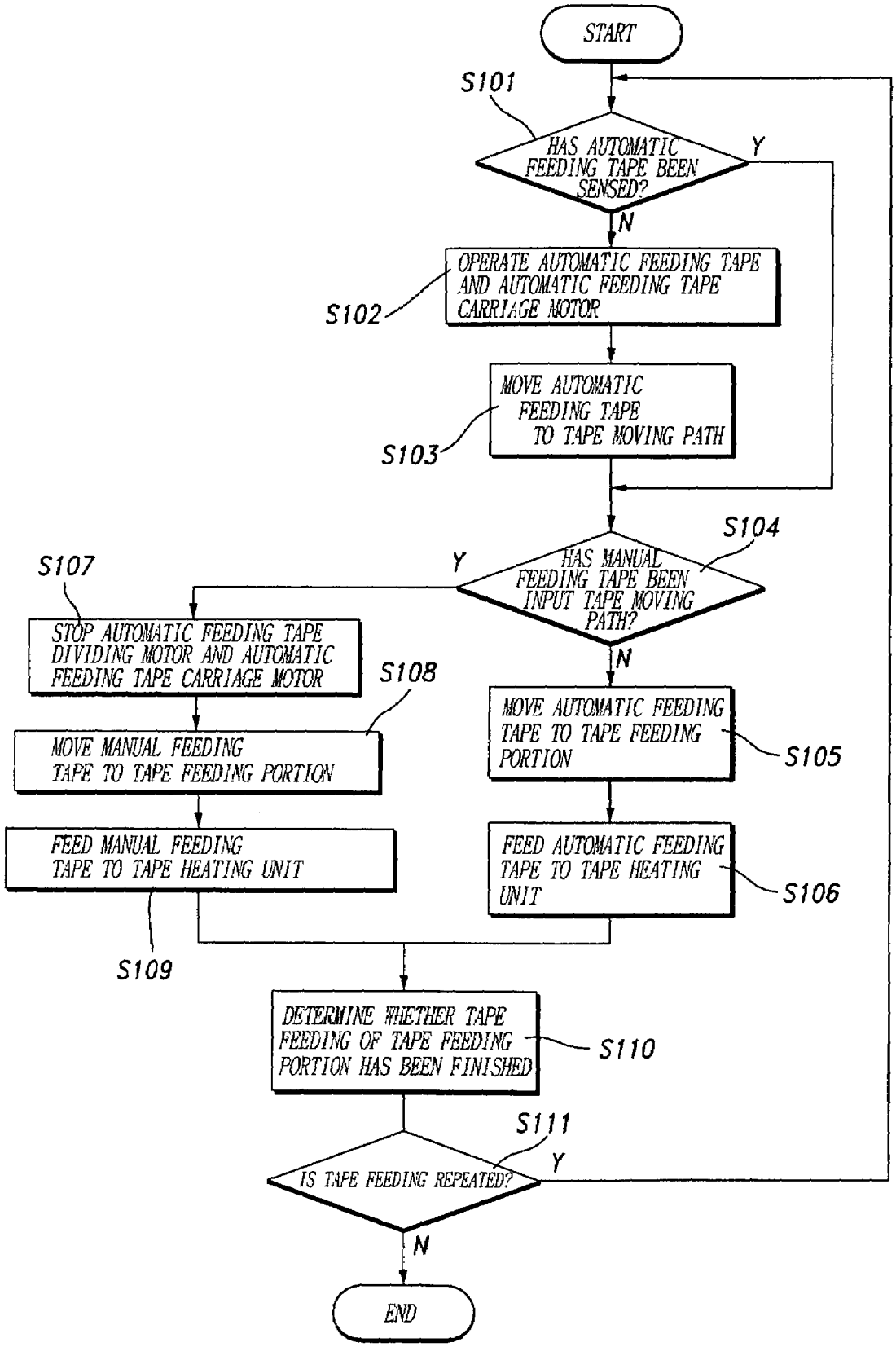
Figure 10:
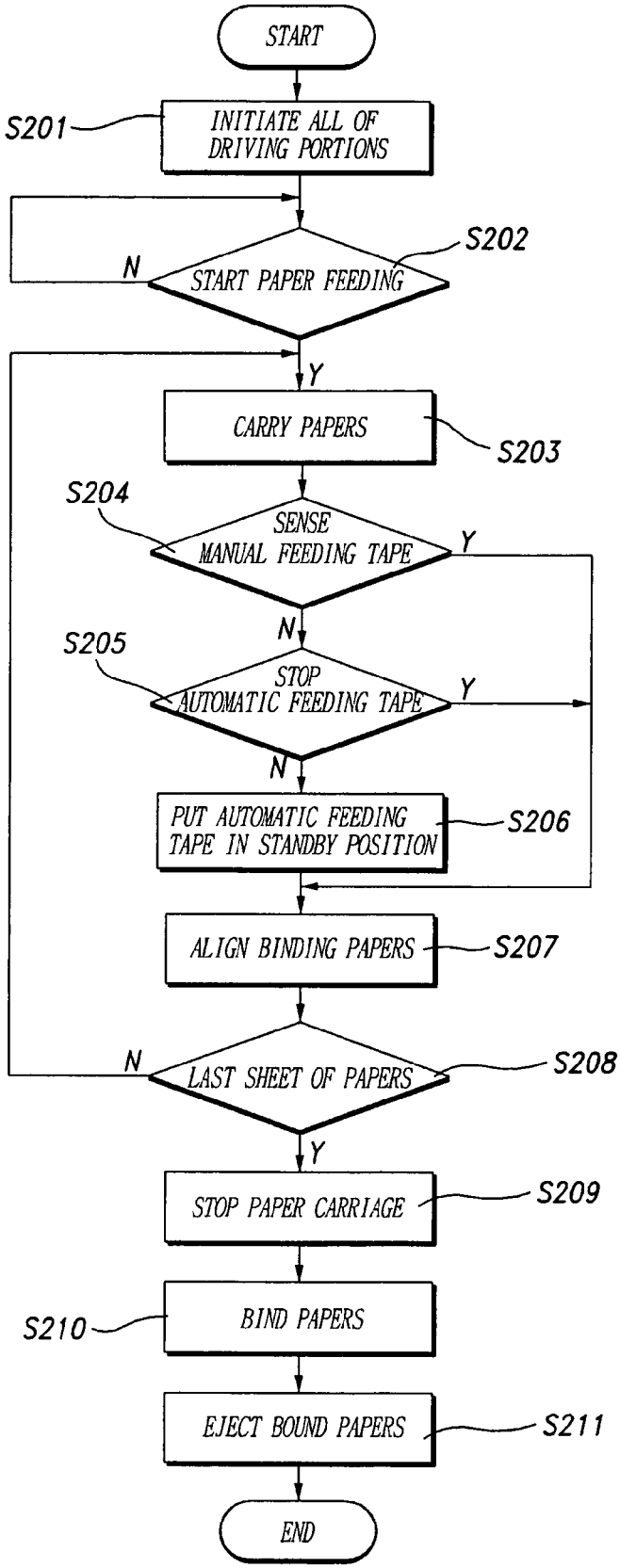
Figure 11:
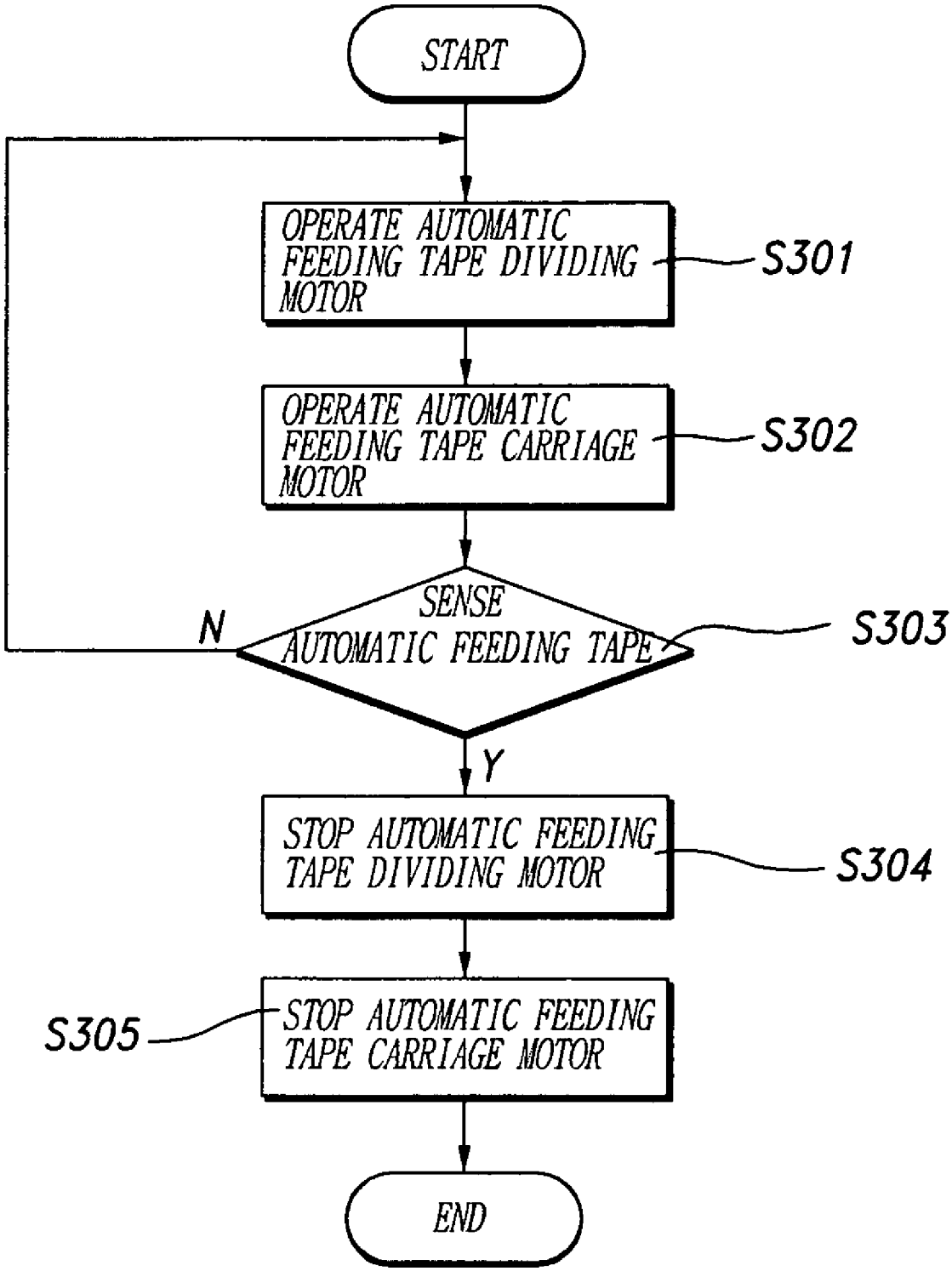

FIGS. 5*a* and 5*b* illustrate a structure of a tape feeder according to the present invention;

FIG. 6 is an enlarged view illustrating a frictional pad of a tape feeder according to the present invention;

FIG. 7 is an exploded view of a tape feeder according to the present invention;

FIG. 8 is an exploded view of a tape feeding portion of a tape feeder according to the present invention;

FIG. 9 is a flow chart illustrating a method of controlling a tape feeder according to the first embodiment of the present invention; and FIGS. 10 and 11 are flow charts illustrating a method of controlling a tape feeder according to the second embodiment of the present invention.

DETAILED DESCRIPTION OF THE PREFERRED EMBODIMENTS

Reference will now be made in detail to the preferred embodiments of the present invention, examples of which are illustrated in the accompanying drawings.

A binding device 1 according to the present invention has the same structure as that of the conventional binding device in the paper carriage 2, the paper aligning unit 3, the binding carriage 4, the tape heating unit 7, and the receiving stacker 8. The binding device 1 of the present invention has an improved structure in the tape feeder 6.

The tape feeder 106 of the present invention includes a stack cassette 56 having automatic feeding tapes 132, 133, 134, . . . cut at a predetermined size, first and second pinion rollers 51 and 52 dividing the automatic feeding tapes built in the stack cassette 56, and a dividing motor 50 dividing the automatic feeding tapes and rotating the first and second pinion rollers simultaneously.

A frictional pad 53 is provided at the position corresponding to the second pinion roller 52. An automatic feeding tape outlet 60 is provided between the frictional pad and the second pinion roller, and the automatic feeding tapes are ejected to a carriage roller 55 through the outlet 60. The carriage roller 55 is driven by an automatic feeding tape carriage motor 65.

Particularly, the frictional pad 53 includes a pressurizing spring 54 that serves to cause elasticity toward the second pinion roller 52. The frictional pad 53 includes an arc shaped frictional surface 61 that serves to easily eject the end of the automatic feeding tape 133 following the automatic feeding tape 132 to the carriage roller. The frictional surface is provided with a separate rubber member to enhance friction of the frictional pad 53. The frictional surface 61 provided in the automatic feeding tape outlet 60 serves to block movement of the automatic feeding tape 133 until the automatic feeding tape 132 is ejected to the carriage roller 55 in case that the automatic feeding tapes 132 and 133 are simultaneously input to the outlet 60.

The first and second pinion rollers 51 and 52 driven by the dividing motor 50 are respectively provided with one-way bearing 62. The carriage roller 55 and an automatic feeding tape sensor 59 are provided at the outside of the outlet 60. The one-way bearing 62 serves to run the pinion rollers idle so that rotational load of the pinion rollers 51 and 52 does not prevent movement of the automatic feeding tape when the automatic feeding tape 132 is ejected to the carriage roller.

Once the automatic feeding tape 132 moves to the carriage roller 55, the dividing motor 50 is stopped. The carriage roller driven by the carriage motor 65 moves the automatic feeding tape 132 so that the front end of the automatic feeding tape is disposed at the position of the automatic feeding tape sensor 59.

Meanwhile, a manual feeding tape slot 88 is provided in the tape moving path 90 so that the manual feeding tape 232 can externally be input to the slot 88. A tape feeding sensor 69 and a tape thickness sensor 79 are provided in the slot 88.

The tape moving path 90 is connected with a tape feeding portion 80. A tape aligning position sensor 89 provided in the tape feeder senses whether the automatic feeding tape and the manual feeding tape fed through the tape moving path have reached the exact position in the tape heating unit. The tape aligned in the exact position is fed to a tape guide 126 of a tape heating unit 107 by a tape feeding motor 75. The tape feeding motor 75 is controlled by signals of the tape aligning position sensor 89 and the tape feeding sensor 69.

In case that the automatic feeding tape not the manual feeding tape is fed to the tape feeder, the automatic feeding tape dividing motor 50 and the ejection motor 65 are stopped when the front end of the automatic feeding tape 132 is moved to the position of the automatic feeding tape sensor 59. Once the sheet of papers to be bound are moved into the tape heating unit, the automatic feeding tape is fed to the tape heating unit by driving of the carriage motor 65 and the tape feeding motor 75. At this time, once the rear end of the tape passes through the automatic tape feeding sensor 59, the carriage motor 65 is stopped. The distance between the tape feeding roller 72 driven by the tape feeding motor 75 and the automatic tape sensor 59 is set so that the front end of the automatic feeding tape is hung in the tape feeding roller 72 when the rear end of the automatic feeding tape passes through the automatic feeding tape sensor 59.

Figure 1:
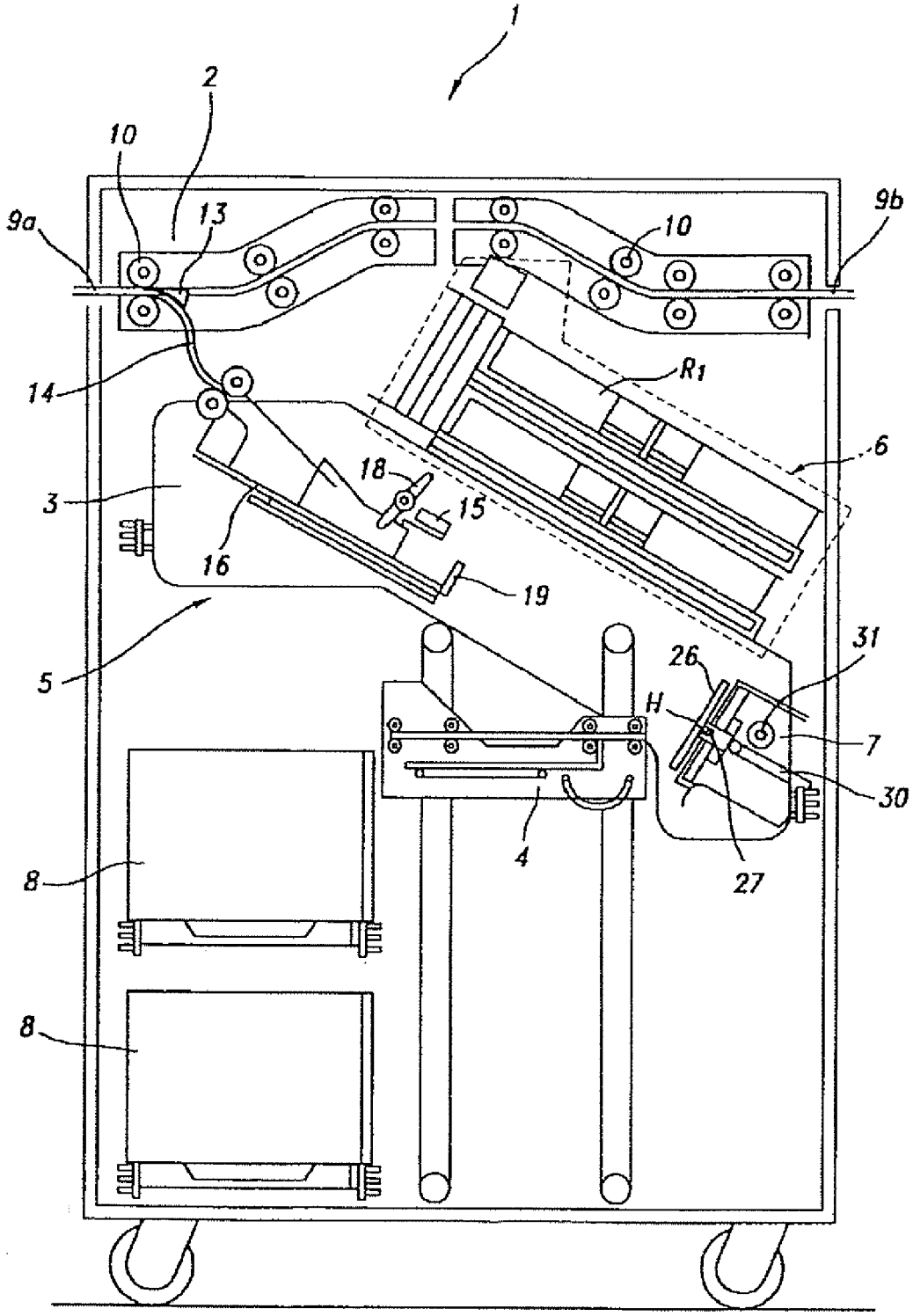
FIG. 1 illustrates a structure of a conventional binding device.
Figure 2:
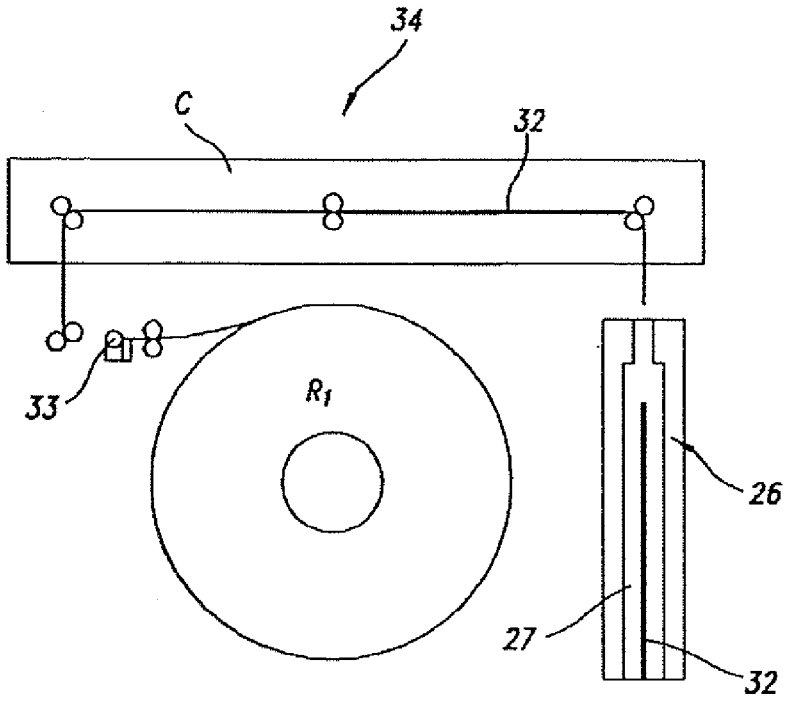
FIG. 2 illustrates a structure of a conventional reel type tape feeder.
Figure 3:
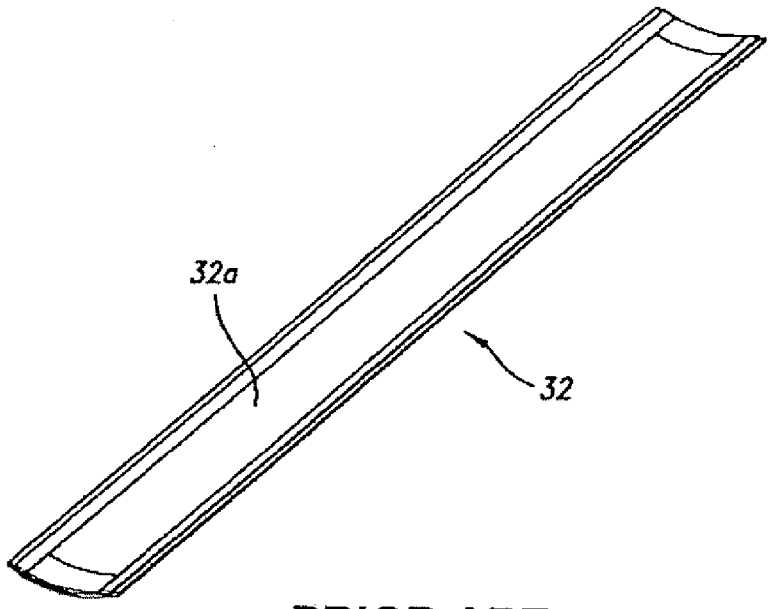
PRIOR ART FIG 3
FIG. 3 illustrates a general structure of a tape used for binding.
Figure 4:
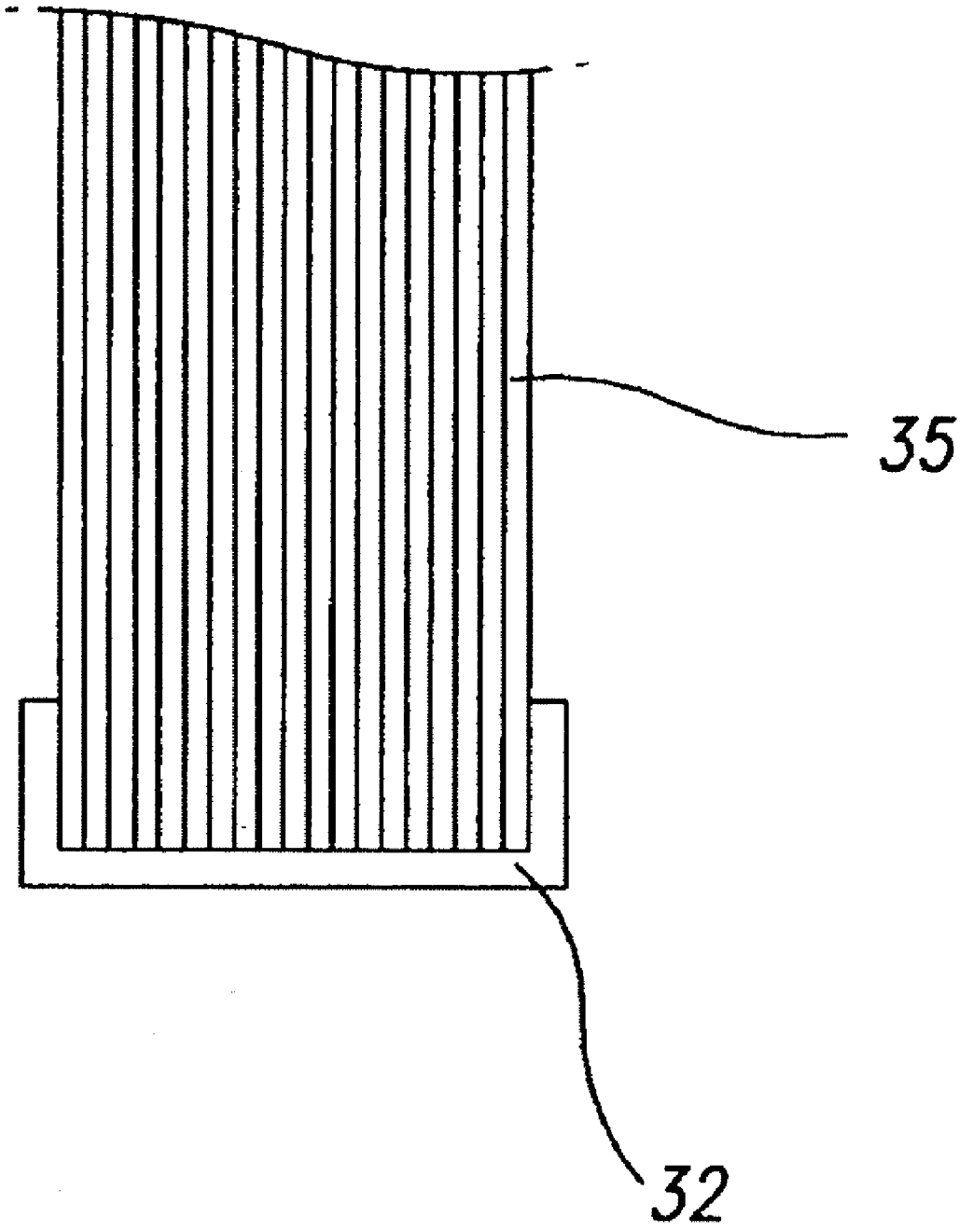
FIG. 4 illustrates a general structure of a sheet of bound papers.

The tape thickness sensor 79 senses the thickness of the tape passing through the tape feeding roller 72 of FIG. 2, i.e., the gap occurring when the tape passes through the roller. Thus, the tape thickness sensor 79 generates a tape feeding error signal when two tapes are simultaneously moved or the manual feeding tape is also input in the step of moving the automatic feeding tape.

The method of controlling the aforementioned tape feeder will be described in more detail with reference to FIG. 9 to FIG. 11.

First Embodiment

A central processing unit (not shown) that controls the tape feeder determines whether the automatic feeding tape moved from the stack cassette 56 has been sensed by the automatic feeding tape sensor 59 in step S101. If not, the central processing unit operates the automatic tape dividing motor 50 and the automatic tape carriage motor 65 in step S102 so that the front end of the automatic feeding tape 132 stacked on the stack cassette moves to the position of the automatic tape sensor 59 provided in the tape moving path 90 in step S103.

Once the front end of the automatic feeding tape 132 is moved to the position of the automatic feeding tape sensor 59, the sensor 59 senses the tape 132 to allow driving of the motors 50 and 65 to be stopped.

The tape feeding sensor 69 senses whether the manual feeding tape 132 has been input to the manual feeding tape slot 88 provided in the tape moving path in step S104. Once the manual feeding tape 232 has been input to the slot 88, the sensor 69 holds movement of the automatic feeding tape 132 and moves the manual feeding tape 232 prior to the automatic feeding tape to the tape feeding portion 80 in a state that the dividing motor 50 and the carriage motor 65 are stopped in step S108. The manual feeding tape 232 moved to the tape feeding portion is moved to the position of the tape aligning position sensor 89 by driving of the tape feeding motor 75 and its position is aligned therein.

Then, the manual feeding tape 23 is fed to the tape guide 126 of the tape heating unit 107 in step S109.

Meanwhile, if the manual feeding tape is not input to the slot 88 provided in the tape moving path 90, i.e., if the tape feeding sensor 69 does not sense the manual feeding tape, the automatic feeding tape carriage motor 65 is driven so that the automatic feeding tape 132 of which front end is set at the position of the automatic feeding tape sensor 59 is moved to the tape feeding portion 80 and the automatic feeding tape 133 stacked on the stack cassette is moved to the tape feeding portion 80 in step S105.

Once the front end of the automatic feeding tape 132 moved to the tape feeding portion 80 starts to be moved to the tape aligning position sensor 89 as it is hung in the tape feeding roller 72 driven by the tape feeding motor 75, the rear end of the automatic feeding tape 132 is deviated from the sensing position of the automatic tape sensor 59.

As shown in FIG. 5*b*, once the automatic tape sensor 59 senses the deviated rear end of the automatic feeding tape 132, the dividing motor 50 is driven.

Subsequently, once the front end of the automatic feeding tape 132 is sensed by the automatic feeding tape sensor 59, driving of the carriage motor 65 and the dividing motor 50 is stopped.

The automatic feeding tape 132 moved to the tape aligning position sensor 89 as it hung in the tape feeding roller 72 is aligned by the signal of the tape aligning sensor and is fed to the tape guide 126 of the tape heating unit 107 in step S106.

In steps S109 and S106, when the manual feeding tape 232 or the rear end of the automatic feeding tape 132 passes through the tape feeding sensor 69, it is determined that feeding of the tape is finished in step S110 so that driving of the tape feeding motor 75 is stopped.

Once feeding of the tape is finished as above, the central processing unit determines whether the tape continues to be fed in step S111. If so, the step is moved to step S101 and feeding cycle operation of the tape is repeated. If not, the operation is ended.

The tape thickness sensor 79 determines that the tape is fed in error when two or more tapes are simultaneously moved or the manual feeding tape is input in the step of moving the automatic feeding tape, thereby stopping driving of the tape feeder.

Second Embodiment

The method of controlling the tape feeder according to the second embodiment of the present invention will be described with reference to FIG. 10 and FIG. 11.

All the driving portions of the binding device are initiated in step S201 and it is determined whether papers start to be fed to the paper aligning unit 3 in step S202. If papers start to be fed to the paper aligning unit 3, the papers are conveyed onto the tray 16 of the paper aligning unit and then stacked thereon in step S203.

Once the papers start to be stacked on the tray, the tape feeding sensor 69 senses whether the manual feeding tape 232 has been input to the manual feeding tape slot 88 in step S204. If the manual feeding tape 232 has not been input to the manual feeding tape slot 88, it is determined whether the automatic feeding tape stacked on the stack cassette 56 has been moved to the standby position of the automatic feeding tape in step S205.

The standby position of the automatic feeding tape means that the automatic feeding tape is stopped at the position where the front end of the automatic feeding tape is sensed by the automatic feeding tape sensor 59.

If the automatic feeding tape is not in the standby position, the step S206 is performed so that the automatic feeding tape is fed to the standby position.

The method of moving the automatic feeding tape to the standby position will described with reference to FIG. 11.

First, the automatic feeding tape dividing motor 50 is driven in step S301. The automatic feeding tape carriage motor 65 is then driven in step S302 so that the automatic feeding tape stacked on the stack cassette is moved to the automatic feeding tape carriage roller 55.

Once the automatic feeding tape stacked on the stack cassette starts to be moved as the automatic feeding tape dividing motor and the automatic feeding carriage motor are driven, the automatic feeding tape sensor 59 senses whether the front end of the automatic feeding tape has been moved in step S303.

Once the front end of the automatic feeding tape is sensed by the automatic feeding sensor 59, the automatic feeding tape dividing motor 50 is stopped in step S304.

Subsequently the automatic feeding carriage motor 65 is stopped in step S305 so that the front end of the automatic feeding tape is in standby state at the position of the automatic feeding sensor 59.

Meanwhile, the papers stacked on the tray of the paper aligning unit are aligned in step S207, and it is determined whether the last sheet of the papers has been stacked on the tray in step S208.

If the sheet of papers is not completely moved, the step of stacking the papers is repeated until movement of the papers is finished.

Once the step of stacking the papers is finished, carriage of the papers is stopped in step S209.

The papers stacked on the tray of the paper aligning unit are moved to the tape heating unit 107 and at the same time the manual feeding tape or the automatic feeding tape in standby state is moved to the tape heating unit 107, so that the binding process of the papers is performed in step S210.

The tape aligning position sensor 89 senses whether the tape fed into the tape heating unit has been exactly aligned. The manual feeding tape or the automatic feeding tape is moved in such a manner that the tape feeding motor 75 and the carriage motor 65 are driven at the time when the papers are moved to the tape heating unit so as to simultaneously rotate the tape feeding roller 72 and the carriage roller 55.

If the tape feeding sensor 69 senses that the manual feeding tape has been input in the step of moving the automatic feeding tape, movement of the automatic feeding tape is stopped. Subsequently, the tape feeder is controlled in such a manner that the tape feeding roller 72 driven by the tape feeding motor 75 is only rotated to first feed the sensed manual feeding tape to the tape heating unit.

Finally, the sheet of papers of which tape binding process is finished is ejected to the outside by the binding carriage 4 in step S211.

As aforementioned, the tape feeder and the method of controlling the same according to the present invention have the following advantages.

The automatic feeding tape 132 and the manual feeding tape 232 are moved through one tape moving path 90. When the automatic feeding tape sensor 59 and the tape feeding sensor 69 provided on the tape moving path 90 respectively sense the automatic feeding tape 132 and the manual feeding tape 232, the manual feeding tape 232 is first moved by the signals of the tape aligning position sensor 89 and the tape feeding sensor 69. Thus, the automatic feeding tape and the manual feeding tape can selectively be fed to the tape heating unit 107. In addition, the small volume of the tape feeder can be obtained and the automatic feeding tape can easily be exchanged with the manual feeding tape and vice versa.

The foregoing embodiments are merely exemplary and are not to be construed as limiting the present invention. The present teachings can be readily applied to other types of apparatuses. The description of the present invention is intended to be illustrative, and not to limit the scope of the claims. Many alternatives, modifications, and variations will be apparent to those skilled in the art.

What is claimed is:

1. In a method of controlling a tape feeder comprising a tape feeding portion structured to selectively feed manual feeding tapes and automatic feeding tapes to a tape heating unit, a stack cassette having the automatic feeding tapes therein, and a tape moving path moving the automatic feeding tapes in the stack cassette to the tape feeding portion, wherein the tape moving path includes a slot into which the manual feeding tapes are externally input, an automatic feeding tape sensor, and a tape feeding sensor, and the tape feeding portion includes a tape aligning position sensor sensing the position where the automatic feeding tape or the manual feeding tape has been fed to the tape heating unit, the method is characterized in that the manual feeding tape prior to the automatic feeding tape is moved to the tape feeding portion by a signal of the tape feeding sensor when the automatic feeding tape sensor and the tape feeding sensor respectively sense the automatic feeding tape and the manual feeding tape.

2. The method according to claim 1, wherein the tape moving path includes a tape thickness sensor that senses whether the manual feeding tape and the automatic feeding tape are overlapped with each other on the tape moving path, and movement of the tape is stopped if the tape thickness sensor senses the tapes overlapped with each other.

3. The method according to claim 2, wherein the stack cassette includes pinion rollers driven by a automatic feeding tape dividing motor and a carriage roller driven by the automatic feeding tape carriage motor, and the tape feeding portion includes a tape feeding roller driven by a tape feeding motor, the tape feeding roller moving the automatic feeding tape or the manual feeding tape to the tape moving path by the signal of the tape feeding sensor.

4. A method of controlling a tape feeder comprising the steps of:

stacking papers on a paper aligning unit after a driving portion of a binding device is initiated;

determining whether an automatic feeding tape stacked on a stack cassette is in a standby position;

driving an automatic feeding tape dividing motor and an automatic feeding tape carriage motor to move the automatic feeding tape stacked on the stack cassette to the standby position if the automatic feeding tape is not in the standby position; and moving a sheet of the papers stacked on the paper aligning unit and the automatic feeding tape in the standby position to a tape heating unit to bind them.

5. The method according to claim 4, wherein the automatic feeding tape is in the standby position by stopping movement of the automatic feeding tape after the automatic feeding tape sensor provided on the tape moving path senses the front end of the automatic feeding tape.

6. The method according to claim 5, wherein the tape moving path further includes a manual feeding tape slot and a tape feeding sensor, and the tape feeding sensor senses the manual feeding tape if the manual feeding tape is fed to the tape moving path through the slot so that the manual feeding tape prior to the automatic feeding tape is moved to the tape heating unit.

7. The method according to claim 6, wherein the automatic feeding tape is moved from the standby position to the tape heating unit by the automatic feeding tape carriage roller and the tape feeding roller, and the manual feeding tape is moved by the tape feeding roller.

8. The method according to claim 7, wherein the automatic feeding tape or the manual feeding tape which has passed through the tape feeding roller is moved to the tape heating unit, and the aligning position of the tape moved to the tape heating unit is sensed by a tape aligning position sensor.

* * * * *